US009516898B2

(12) United States Patent
Liu

(10) Patent No.: US 9,516,898 B2
(45) Date of Patent: Dec. 13, 2016

(54) ELECTRONIC CIGARETTE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 776 days.

(21) Appl. No.: 13/917,272

(22) Filed: Jun. 13, 2013

(65) Prior Publication Data

US 2014/0305452 A1 Oct. 16, 2014

Related U.S. Application Data

(63) Continuation of application No. PCT/CN2013/074163, filed on Apr. 12, 2013.

(51) Int. Cl.
*A24F 47/00* (2006.01)

(52) U.S. Cl.
CPC ..... *A24F 47/008* (2013.01)

(58) Field of Classification Search
CPC ..... A24F 47/002; A24F 47/008; A24F 13/02; A61M 15/06; A61M 16/18; A61M 16/0493; A61M 16/0495; A61M 16/06
USPC ..... 131/329
See application file for complete search history.

(56) References Cited

U.S. PATENT DOCUMENTS 4,771,796 A 9/1988 Myer
2006/0191546 A1* 8/2006 Takano ..... A24F 47/002 131/270
2011/0011396 A1* 1/2011 Fang ..... A24F 47/008 128/202.21

(Continued)

FOREIGN PATENT DOCUMENTS

CN 1530041 A 9/2004
CN 102014996 A 4/2011

(Continued)

OTHER PUBLICATIONS

Translation of CN202566289.*

(Continued)

*Primary Examiner* — Mohamed K Ahmed Ali
(74) *Attorney, Agent, or Firm* — Tim Tingkang Xia, Esq.; Locke Lord LLP

(57) ABSTRACT

The present invention relates to an electronic cigarette, which includes a smoking component having a suction nozzle and a battery rod. The suction nozzle is configured at an end of the smoking component and is far away from the battery rod. The smoking component further comprises a receiving chamber having an atomizer base which separates the receiving chamber into an atomized cavity and a cavity. One end of the suction nozzle, being far away from the battery rod, has an air outlet, and another end of the suction nozzle, being close to the cavity, has an air inlet. The smoking component has airflow through channel connecting the air outlet, the cavity and the air inlet. The electronic cigarette of the present invention is easy to be manufactured, and the batteries in the battery rod of the electronic cigarette can be protected from be damaged by the hot smoking airflow.

6 Claims, 5 Drawing Sheets

(56) References Cited

U.S. PATENT DOCUMENTS

2011/0303231 A1* 12/2011 Li ..... A24F 47/008
131/329

FOREIGN PATENT DOCUMENTS

| | | | |
|---|---|---|---|
| CN | 202566289 | U | 12/2012 |
| CN | 202819630 | U | 3/2013 |
| KR | 1186229 | B1 | 9/2012 |

OTHER PUBLICATIONS

International Search Report mailed Jan. 23, 2014 in International Application No. PCT/CN2013/074163 filed Apr. 12, 2013.

* cited by examiner

ELECTRONIC CIGARETTE

CROSS-REFERENCE TO RELATED APPLICATIONS

This application is a continuation of International Patent Application No. PCT/CN2013/074163, with an international filing date of Apr. 12, 2013, designating the United States, now pending. The contents of these specifications are incorporated herein by reference.

BACKGROUND

1. Technical Field

The present invention relates to electric heating products, and more particularly to an electronic cigarette.

2. Description of Related Art

At present, an air inlet of an electronic cigarette is usually defined in an area of thread junction between an atomizer and a battery rod or in an area of a light cap. The air inlet defined in the area of thread junction make producing process complicated, while the air inlet defined in the area of a light cap would make the batteries in the battery rod of the electronic cigarette be damaged by the backflow of the hot atomized smoke.

Therefore, there is room for improvement within the art.

SUMMARY OF THE INVENTION

The object of the present invention is to provide an electronic cigarette, which has an air inlet on a suction nozzle and an airflow channel in the smoking component, to avoid the drawbacks of complicated manufacturing process, inconvenient to use and the batteries may be damaged in the prior art.

In order to overcome various shortcomings in the prior art, some embodiments of an electronic cigarette of the present invention are provided, including:

a smoking component comprising a suction nozzle;

a battery rod;

the suction nozzle is located at an end of the smoking component and is far away from the battery rod; The smoking component internally comprises a receiving chamber having an atomizer base which separates the receiving chamber into an atomized cavity and a cavity; one end of the suction nozzle, being far away from the battery rod has an air outlet, and another end of the suction nozzle, being close to the cavity, has an air inlet; the smoking component has an airflow through channel connecting the air outlet, the cavity and the air inlet.

The airflow through channel includes a first airflow channel formed by a hollow inside the atomizer base communicating with the atomized cavity and the air outlet; the first airflow channel is communicated with the cavity.

The airflow through channel further includes a second airflow channel formed by the cavity communicating with the air inlet.

The smoking component further includes a sleeve, and the suction nozzle includes a main body and a first connecting portion axially extended toward the battery rod; a diameter of the first connecting portion is less than that of the main body, and the first connecting portion has a first groove; the sleeve is sleeved on the first connecting portion, a channel surrounded by the sleeve and the first groove is defined as a first passage, and the first passage communicates with the cavity and the air inlet to cooperatively form the second airflow channel.

The smoking component further includes a sleeve, and the suction nozzle includes a main body and a first connecting portion axially extended toward the battery rod; a diameter of the first connecting portion is less than that of the main body, and an inner wall of the sleeve has a second groove; the first connecting portion is inserted in the sleeve, a channel surrounded by the first connection portion and the second groove is defined as a second passage, and the second passage communicates with the cavity and the air inlet to cooperatively form the second airflow channel.

The air inlet is a first notch, which is defined on the suction nozzle and communicates with the first groove or the second groove; the suction nozzle axially extends to the cavity.

The air inlet is a through hole defined on the suction nozzle, which is radially through the suction nozzle to the cavity, and the air inlet communicates with the cavity to cooperatively form the second airflow channel.

The suction nozzle axially extends to or beyond the cavity.

The air outlet can be axially or radially defined at an end of the suction nozzle, which is far away from the battery rod.

A cross-sectional area of the air inlet, the air outlet, the first groove, or the second groove is 2-7 $mm^2$.

An electronic cigarette of the present invention has following benefit effect: because an air inlet is located at outer edge of the suction nozzle, and an airflow channel is arranged inside a smoking component to communicate with the air inlet and an air outlet, thereby atomized smoke will not pass through the inner of a battery component, which would avoid the battery rod from being damaged. Because the suction nozzle is at least extended into the cavity, therefore the length of the sleeve can be reduced or can be omitted, which is convenient to manufacture. Also the airflow channel is not defined at an area of thread junction or in the battery rod, which is easy to manufacture.

BRIEF DESCRIPTION OF THE DRAWINGS

The features and advantages of the present invention will be apparent from the following further description in conjunction with the accompanying drawings illustrating its preferred embodiment, and in which.

DETAILED DESCRIPTION OF THE EMBODIMENTS

Figure 1:
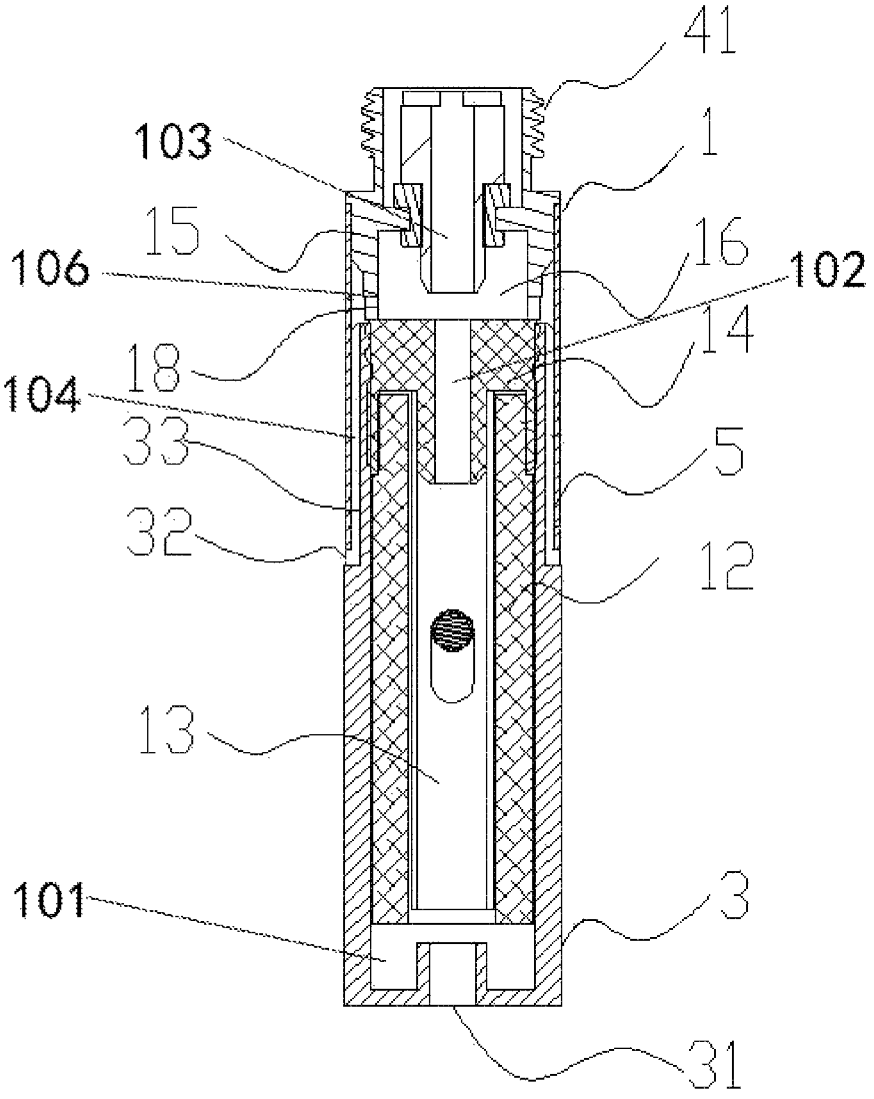
FIG. 1 is a structure schematic view of a first embodiment of a smoking component.

In order to understand the technical features, purpose and the effect of the present invention more clearly, the specific embodiments of the present invention will be described referring to the drawings.

Figure 3:
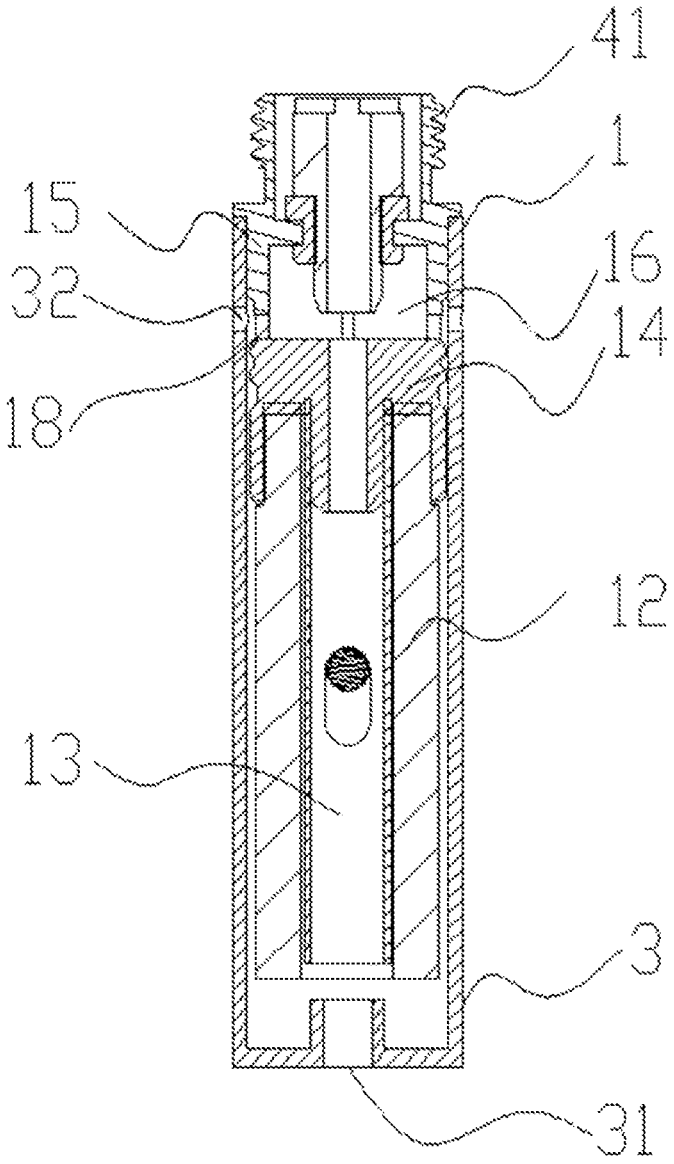
FIG. 3 is a structure schematic view of a second embodiment of a smoking component.
Figure 6:
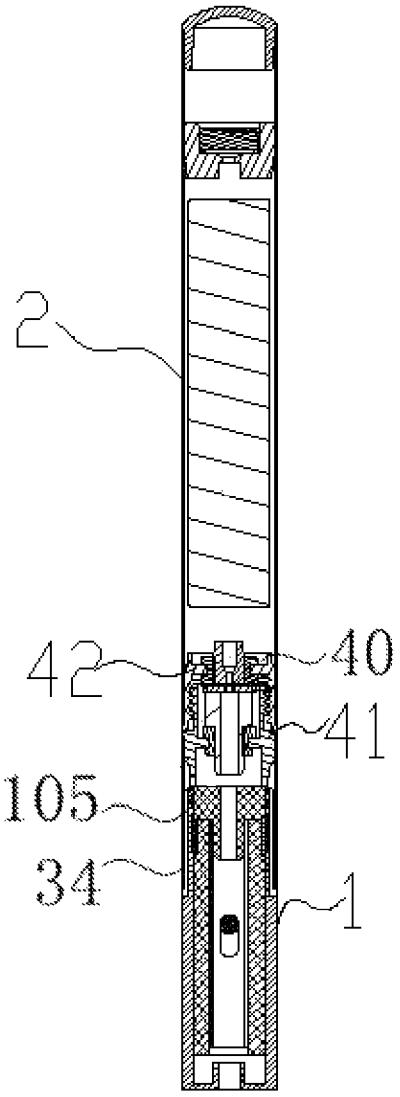
FIG. 6 is a structure schematic view of an electronic cigarette including the smoking component of FIG. 1.

Referring to FIG. 1, FIG. 3 or FIG. 6, preferred embodiment of an electronic cigarette (not labeled) is provided. The electronic cigarette includes a smoking component 1, a battery rod 2, and a suction nozzle 3 configured at an end of the smoking component 1 and far away from the battery rod 2. A receiving chamber 101 is defined in the smoking component 1, and the receiving chamber 101 includes an atomizer base 14 separating the receiving chamber 101 into an atomized cavity 13 and a cavity 16. One end of the suction nozzle, being far away from the battery rod, has an air outlet 31, and another end of the suction nozzle, being close to the cavity 16, has an air inlet 32; the smoking component has an airflow through channel connecting the air outlet 31, the cavity 16 and the air inlet 32.

In the illustrated embodiment, the air inlet 32 is defined at the circumference of the suction nozzle 3, and the airflow channel for the atomized smoke flowing is defined in the smoking component 1. Therefore the atomized smoke does not flow via the battery rod 2, and the battery rod 2 is not affected or damaged by the heat from the smoking process. In specific, the smoking component 1 includes an atomizer 12 and the suction nozzle 3.

The airflow channel includes a first airflow channel 102 and a second airflow channel 103 communicated with the first airflow channel 102. The hollow inside the atomizer base 14 communicates with the atomized cavity 13 and the outlet 31 to form the first airflow channel 102. The first airflow channel 102 is communicated with the cavity 16.

There are two embodiments of the second airflow channel 103.

Embodiment 1

A First Method of Embodiment 1

Figure 2:
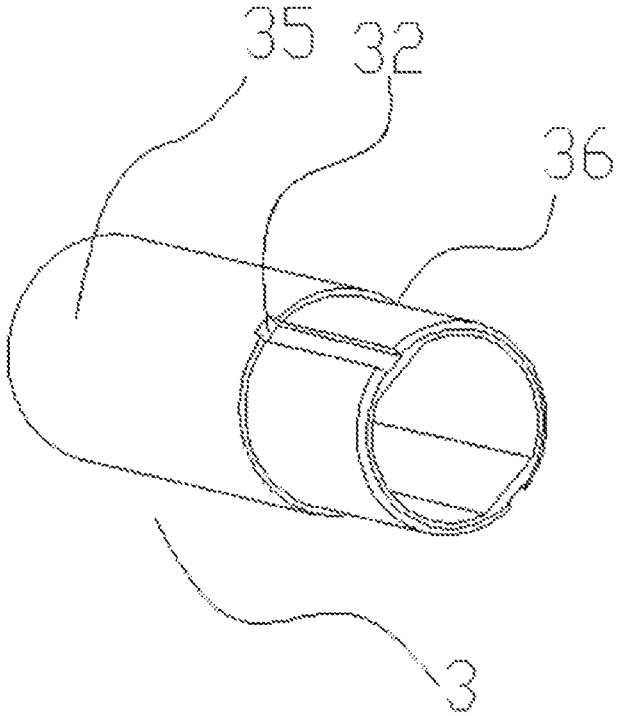
FIG. 2 is a structure schematic view of a suction nozzle of the smoking component of FIG. 1.

Referring to FIG. 1 and FIG. 2, the smoking component 1 includes a sleeve 5. The suction nozzle 3 includes a main body 35 and a first connecting portion 36 axially extended toward the battery rod 2. The diameter of the first connecting portion 36 is less than that of the main body 35, and the first connecting portion 36 has a first groove 33. The sleeve 5 is sleeved on the first connecting portion 36, and a channel surrounded by the sleeve 5 and the first groove 33 is defined as a first passage 104. The first passage 104 communicates with the cavity 16 and the air inlet 32 to cooperatively form the second airflow channel 103.

A second method of embodiment 1:

The smoking component 1 includes a sleeve 5. The suction nozzle 3 includes a main body 35 and a first connecting portion 36 axially extended toward the battery rod 2. The diameter of the first connecting portion 36 is less than that of the main body 35. The inner wall of the sleeve 5 has a second groove 34, and the first connecting portion 36 is inserted in the sleeve 5, thereby a channel surrounded by the first connection portion 36 and the second groove 34 is defined as a second passage 105. The second passage 105 communicates with the cavity 16 and the air inlet 32 to form the second airflow channel 103.

The difference between the first and second methods of embodiment 1 is that the first groove 33 is defined at the first connecting portion 36 in the first method while the second groove 34, its function is same as the first groove 33, is defined at the inner wall of the sleeve 5.

It is to be understood that a cross-section shape of the first groove 33 or the second groove 34 can be any of square, semicircle, triangle, or rectangle. And the first groove 33 or the second groove 34 can be axially defined at the first connecting portion 36 or the sleeve 5 along a straight line or along a curve.

The air inlet 32 is a first notch, which is defined on the suction nozzle 3 and communicates with the first groove 33 or the second groove 34.

In the illustrated embodiment, the first groove 33 or the second groove 34 is preferred axially defined at the first connecting portion 36 or the sleeve 5 along a straight line, and the cross-section shape of the first groove 33 or the second groove 34 is rectangle. The air inlet 32 is preferred defined on the adjacent edge area of the main body 35 and the first connecting portion 36, and the first notch is rectangular.

In the illustrated two methods of embodiment 1, the second airflow channel 103 is defined either through the sleeve 5 or the first connection portion 36 of the suction nozzle 3. Also the suction nozzle 3 is axially extended to the cavity 16 in the two methods. It is to be understood that the suction nozzle 3 is at least extended to the edge of the atomizer base 14, which is adjacent to the cavity 16.

Embodiment 2

Figure 4:
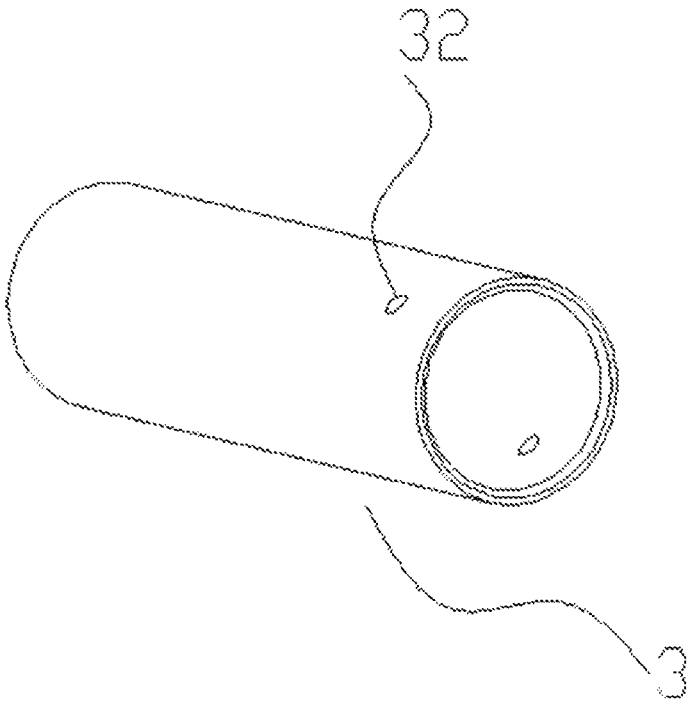
FIG. 4 is a structure schematic view of a suction nozzle of the smoking component of FIG. 3.
Figure 5:
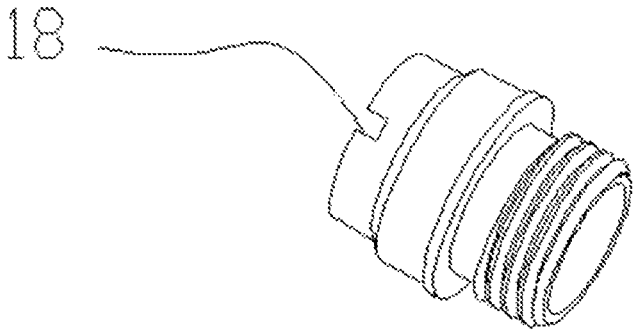
FIG. 5 is a structure schematic view of a connecting portion of the smoking component of FIG. 1 or FIG. 3.

Referring to FIG. 3 and FIG. 4, the air inlet 32 is a through hole, which is radially through the suction nozzle 3 into the cavity 16, and the second airflow channel 103 is formed by the air inlet 32 and the cavity 16 communicating with each other. The suction nozzle 3 axially extends to or beyond the cavity 16.

In the illustrated embodiment 2, a sleeve is not needed, the suction nozzle 13 axially extends to or beyond the cavity 16 to play the role of the sleeve 5 in the first embodiment, and the atomized cavity 13 and the atomizer base 14 are both located inside the suction nozzle 3. The air outlets 31 can be axially or radially defined on an end of the suction nozzle 3, and the end is far away from the battery rod 2.

In the first embodiment, there can be one or more second passages 105. In both the first and second embodiment, there can be one or more air inlets 32. Usually, for the uniformity of the atomized smoke, two second passages 105 and two air inlets 32 are symmetrically defined in the electronic cigarette.

In the first embodiment, the cavity 16 is defined in the sleeve 5, while the cavity 16 is defined in the suction nozzle 3 in the second embodiment. It is to be understood that the cavity 16 can be defined in other components.

In the present invention, referring to FIG. 1 and FIG. 3, the electronic cigarette further includes a second connecting portion 40 connecting the smoking component 1 and the battery rod 2. The second connecting portion 40 includes an upper connecting portion 41 and a lower connecting portion 42. The upper connecting portion 41 has an inserting portion 15 inserted in the smoking component 1. The end of the inserting portion 15 contacts with an end of the atomizer base 14. It is to be understood that the cavity 16 is a cavity surrounded by the upper connecting portion 41 and the end of the atomizer base 14.

The inserting portion 15 has a first through-hole 18 on the circumference thereof. In the first embodiment, the cavity 16 is communicated with the air inlet 32 via the first through-hole 18 and the first 104 or second passage 105 in the first or second methods. In the second embodiment, the first through-hole 18 is configured to correspond to and communicate with the air inlet 32, preferably the central axis of the first through hole 18 and the air inlet 32 is same. The air inlet 32, the first through-hole 18 and the cavity 16 are communicated with each other and cooperatively form the second airflow channel 103.

It is to be understood that a second notch can be defined at the edge of the inserting portion 15 contacting with the end of the atomizer base 14, thereby the second notch and the end of the atomizer base 14 cooperatively form the first through-hole 18. The shape of the first through-hole 18 can be selected according to need, such as circle, triangle, or square.

Preferably, the shape of the second notch is rectangle, so that it is easy to manufacture.

When there is the inserting portion 15, the periphery of the end of the inserting portion 15 contacting the atomizer base 14 has an annular recess 106, which can store certain air to providing a buffer zone before the air entering the cavity 16, the airflow flows from the air inlet 32, though the first through hole 18, and then into the cavity 16. Thereby it keeps the continuity of the air during inhaling.

In the present invention, the cross-sectional area of the first through-hole 18, air inlet 32, air outlet 31, first groove 33, or second groove 34 is 2-7 $mm^2$, which ensures the air flow quantity and velocity during inhaling.

In the present invention, the suction nozzle 3 can extend into the cavity 16, thereby the length of the sleeve 5 can be reduced or can be omitted, which is easy to manufacture and install.

In the present invention, the airflow channel is formed via the air inlet 32 defined in the suction nozzle 3 communicating with the first groove 33 or the second groove 34, or just a through-hole defined on the suction nozzle 3, which is easy to manufacture. The airflow channel is located inside the smoking component 1 and communicates with the air inlet 32 and air outlet 31, which avoids that the hot atomized smoke flows back into the battery rod 2, therefore the batteries in the battery 2 are protected from being damaged.

It should be emphasized that the above-described embodiments of the present invention, particularly, any preferred embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed:

1. An electronic cigarette, comprising:

a smoking component;

a battery rod;

the smoking component further comprising a suction nozzle; the suction nozzle configured at an end of the smoking component and opposite to the battery rod, wherein the smoking component has a receiving chamber including an atomizer base which separates the receiving chamber into an atomized cavity and a cavity;

one end of the suction nozzle, being far away from the battery rod, has an air outlet, and another end of the suction nozzle, being close to the cavity, has an air inlet;

the smoking component has an airflow through channel connecting the air outlet, the cavity and the air inlet;

wherein the airflow through channel includes a first airflow channel formed by a hollow inside the atomizer base communicating with the atomized cavity and the air outlet the first airflow channel is communicated with the cavity;

wherein the airflow through channel further comprises a second airflow channel formed by the cavity communicating with the air inlet;

wherein the smoking component further includes a sleeve, and the suction nozzle includes a main body and a first connecting portion axially extended toward the battery rod; a diameter of the first connecting portion is less than that of the main body, and the first connecting portion has a first groove; the sleeve is sleeved on the first connecting portion, a channel surrounded by the sleeve and the first groove is defined as a first passage, and the first passage communicates with the cavity and the air inlet to cooperatively form the second airflow channel; or wherein the smoking component further includes a sleeve, and the suction nozzle includes a main body and a first connecting portion axially extended toward the battery rod; a diameter of the first connecting portion is less than that of the main body, and an inner wall of the sleeve has a second groove; the first connecting portion is inserted in the sleeve, a channel surrounded by the first connection portion and the second groove is defined as a second passage, and the second passage communicates with the cavity and the air inlet to cooperatively form the second airflow channel.

2. The electronic cigarette of claim 1, wherein the air inlet is a first notch, which is defined on the suction nozzle and communicates with the first groove or the second groove; the suction nozzle axially extends to the cavity.

3. The electronic cigarette of claim 1, wherein the air inlet is a through hole defined on the suction nozzle, which is radially through the suction nozzle to the cavity, and the air inlet communicates with the cavity to cooperatively form the second airflow channel.

4. The electronic cigarette of claim 2, wherein the suction nozzle axially extends to or beyond the cavity.

5. The electronic cigarette of claim 1, wherein the air outlet can be axially or radially defined at an end of the suction nozzle, which is far away from the battery rod.

6. The electronic cigarette of claim 2, wherein a cross-sectional area of the air inlet, the air outlet, the first groove, or the second groove is 2-7 $mm^2$;

wherein, the first groove and the second groove are straight lines or curves;

wherein, the electronic cigarette further includes a second connecting portion connecting the smoking component and the battery rod; the second connecting portion includes an upper connecting portion and a lower connecting portion; the upper connecting portion has an inserting portion inserted in the smoking component the end of the inserting portion contacts with an end of the atomizer base; the periphery of the end of the inserting portion contacting the atomizer base has an annular recess.

* * * * *